United States Patent [19]

Hosono

[11] Patent Number: 4,830,526

[45] Date of Patent: May 16, 1989

[54] KEYBOARD SWITCH

[75] Inventor: Kunio Hosono, Iwaki, Japan

[73] Assignee: Alps Electric Co., Ltd., Japan

[21] Appl. No.: 188,654

[22] Filed: Apr. 29, 1988

Related U.S. Application Data

[63] Continuation of Ser. No. 22,266, Mar. 5, 1987, abandoned.

[30] Foreign Application Priority Data

Jul. 2, 1986 [JP] Japan ..... 61-101925[U]

[51] Int. Cl.[4] ..... B41J 5/12

[52] U.S. Cl. ..... 400/490; 400/472

[58] Field of Search ..... 400/472, 490; 235/145 R, 146

[56] References Cited

U.S. PATENT DOCUMENTS

| | | | |
|---|---|---|---|
| 3,169,701 | 2/1965 | Dombrowski | 235/145 |
| 3,962,556 | 6/1976 | Kravchuck | 235/145 R |
| 4,188,136 | 2/1980 | Bedocs | 400/276 |

*Primary Examiner*—Edgar S. Burr
*Assistant Examiner*—James Lisehora
*Attorney, Agent, or Firm*—Guy W. Shoup; Paul J. Winters; Stephen L. Malaska

[57] ABSTRACT

A keyboard switch comprising a plurality of switch bodies arranged on an attachment plate, a key top, sufficiently larger than the switch body, attached to at least one switch body, a cut-away portion or opening formed in the attachment plate between the key top and a base plate, and circuit parts located in a space which is formed by the cut-away portion or opening, the underside of the key top and the base plate, so that switches and circuit parts can be arranged to efficiently use the space on the base plate.

2 Claims, 2 Drawing Sheets

KEYBOARD SWITCH

This is a continuation application from application Ser. No. 022,266 filed Mar. 5, 1987, now abandoned.

BACKGROUND OF THE INVENTION (a) Field of the Invention

The present invention relates to a construction of the keyboard switch used as an input unit for personal computers, word processors and the like.

(b) Prior Art

In the case of the keyboard switch comprising a plurality of switches arranged on a sheet of base plate, switches to each of which a key top of common size (1×1) is attached and those to each of which a large key top (1×2 or 1×3) used as the function key or the like is attached are arranged on the base plate and various kinds of circuit parts except these switches are mounted on the base plate as well. Therefore, the base plate is needed to have a space for the switches and another space for the circuit parts. The construction of the conventional keyboard switch will be described with reference to FIG. 4. Numeral 21 represents an attachment plate made of iron, and switches 22, 23 and 24 to which key tops of common size are attached and a switch 25 to which a large key top is attached are arranged on the attachment plate 21. A part of the attachment plate 21 is cut away to form a space in which circuit parts are mounted on a base plate 26. Numeral 27 denotes one of high circuit parts which corresponds to the choke coil, for example. Numeral 28 denotes one of low circuit parts which corresponds to the fixed resistor, for example. The low circuit parts can be arranged between the attachment plate 21 and the base plate 26, but the high circuit parts cannot be mounted on the base plate 26 without cutting away a part of the attachment plate 21, as shown in FIG. 4. The base plate 26 is thus needed to have the space for the circuit parts in addition to the other space for the switches.

SUMMARY OF THE INVENTION

In the case of the multi-functioned keyboard switch having an increased number of keys, the number of switches and circuit parts arranged on the base plate is naturally increased, thereby causing the base plate to be large-sized to contain the increased number of switches and circuit parts thereon. The object of the present invention is therefore to more efficiently arrange the switches and the circuit parts on the base plate.

A keyboard switch of the present invention comprises a plurality of switch bodies, a key top, sufficiently larger than the switch body, attached to at least one of the switch bodies, a cut-away portion or opening provided in an attachment plate between the key top and the base plate, and circuit parts arranged in the cut-away portion or opening between the underside of the key top and the base plate.

According to the keyboard switch of the present invention as described above, the key top sufficiently larger than the switch body is attached to the switch body and the circuit parts can be arranged under the key top, thereby enabling the space on the base plate to be efficiently used.

BRIEF DESCRIPTION OF THE DRAWINGS

FIGS. 1 through 3 show an example of the keyboard according to the present invention, in which FIG. 1 is a perspective view showing a main portion of the keyboard, FIG. 2 a plan showing the main portion of the keyboard, and FIG. 3 a side view showing the main portion of the keyboard.

DETAILED DESCRIPTION OF THE PREFERRED EMBODIMENT

Figure 1:
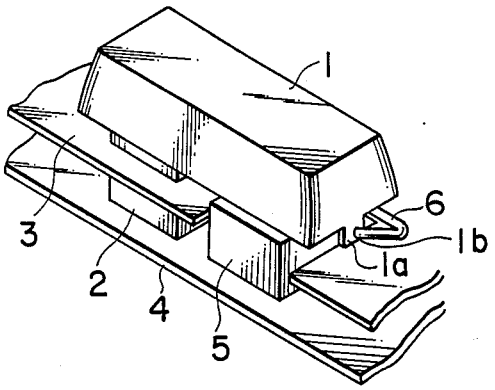
Figure 2:
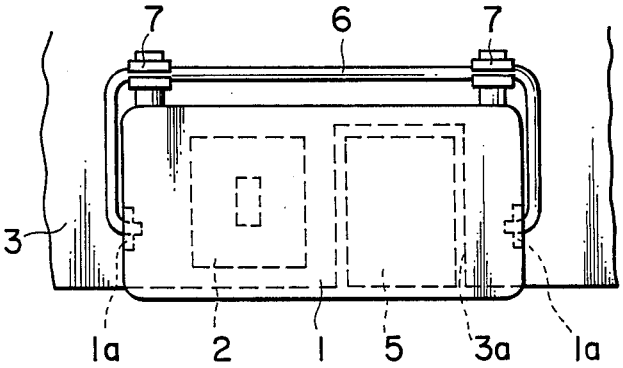
Figure 3:
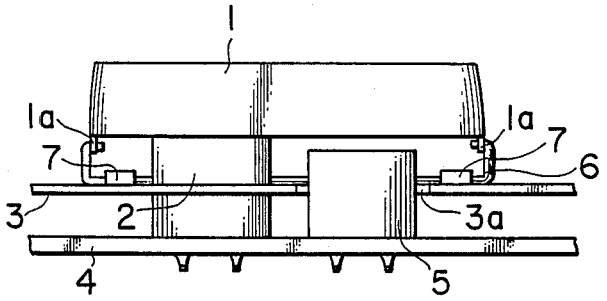
Figure 4:
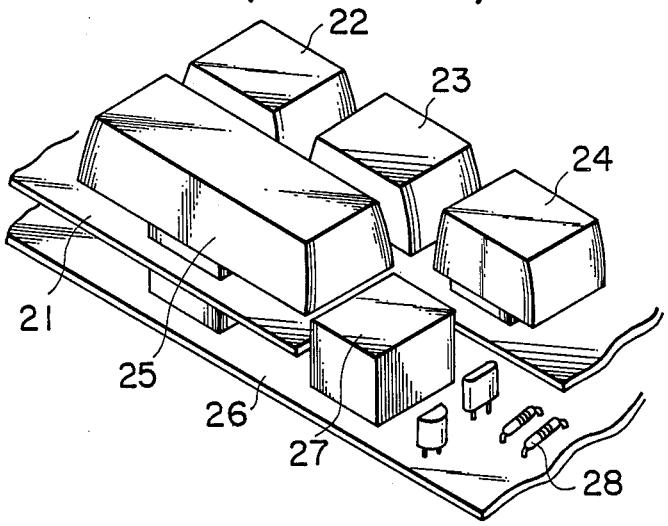
FIG. 4 (Prior Art)
FIG. 4 is a perspective view showing a main portion of the conventional keyboard.

FIG. 1 is a perspective view showing a part of a keyboard switch according to the present invention, and FIGS. 2 and 3 are plan and side views showing the part of it. The keyboard switch of the present invention will be described with reference to these FIGS. 1 through 3. Numeral 1 represents a key top made of synthetic resin, and this key top 1 is two times larger in size than a switch body. Support projections 1a and 1a extend downward from those both sides of the key top 1 which are located in the longitudinal direction thereof, and each of the support projections **1*a* and 1*a* is provided with a bore 1*b*. Numeral 2 denotes the switch body attached to an attachment plate 3 which is made of iron. Although omitted in the Figures, a plurality of switch bodies are attached to the attachment plate 3. As shown in FIG. 2, the attachment plate 3 is provided with a cut-away portion 3*a*. Numeral 4 denotes a base plate on which a wiring pattern is formed, and the switch body 2 and circuit parts 5 are mounted on the base plate 4. Terminals of the switch body 2 and circuit parts 5 are soldered to the wiring pattern on the base plate 4 (see FIG. 3**).

The circuit parts 5 are high and correspond to the choke coil, for example. The circuit parts 5 are located in a space (or cut-away portion **3*a*) between the key top 1, sufficiently larger than the switch body 2, and the base plate 4. Even when the key top 1 is pushed down by a finger, it is left untouched with the circuit parts 5**.

Numeral 6 represents a lever member made by bending a metal rod. This lever member 6 serves to keep the key top 1 parallel to the attachment and base plates 3 and 4, when the key top 1 is pushed down to render the switch operative. Numeral 7 denotes holder members made of synthetic resin. These holder members 7 are fixed to the attachment plate 3 and hold a straight portion of the lever member 6 swingable. When the key top 1 is pushed down, therefore, it can move parallel to the base plate 4 to achieve reliable switching operation and it can be left untouched with the circuit parts 5 located in the cut-away portion 3a of the attachment plate 3.

In the case of the embodiment shown in FIGS. 1 through 3, the key top 1 is located near the edge of the attachment plate 3. The attachment plate 3 is thus provided with the cut-away portion 3a to contain the circuit parts 5. In a case where the key top 1 is not located near the edge of the attachment plate 3, however, the attachment plate 3 may be provided with an opening which serves as a space for containing the circuit parts 5.

The present invention is intended to effectively use the space under the key top. The keyboard switch has been multi-functioned these days to increase the number of keys used. In order to meet this tendency, the present invention enables the total space to be kept as small as possible and necessary circuit parts to be efficiently located in this small space.

I claim:

1. In a keyboard switch for a keyboard comprising a plurality of key tops arranged in an array, an attachment plate disposed in parallel with and spaced beneath the array of key tops, a base plate disposed in parallel with and spaced by a given spacing beneath the attachment plate, a plurality of switch bodies mounted on the base plate and attached so as to project upward through the attachment plate, each of the key tops being mounted over a respective one of the switch bodies such that it can be pushed down thereon to render a switch in the switch body operative, attachment means for movably attaching each of the key tops to the attachment plate mounted over the respective switch bodies, and circuit elements mounted on the base plate which are electrically connected to the keyboard switches for operation of the keyboard, wherein said circuit elements include a larger circuit element having a height greater than the spacing between the base plate and the attachment plate, the improvement comprising at least one key top on said keyboard having a width substantially wider than the associated switch body over which said one key top is mounted, and said larger circuit element being mounted on said base plate adjacent to and independently of the associated switch body of said at least one key top, a cut away portion in said attachment plate under said at least one key top and aligned with said larger circuit element, said circuit element having a height larger than the given spacing between said base plate and said attachment plate but less than the combined spacing between said base plate and the keytops and being arranged on said base plate so as to project through said cut away portion in said attachment plate and extend under said at least one key top, whereby said larger circuit element can be accomodated on said keyboard without increasing the spacing between the base and attachment plates and, consequently, the volume taken up by the keyboard.

2. In a keyboard switch for a keyboard according to claim 1, wherein said large circuit element is a substantially cuboid-shaped large circuit element.

* * * * *